US008287142B2

(12) United States Patent
Pickard et al.

(10) Patent No.: US 8,287,142 B2
(45) Date of Patent: Oct. 16, 2012

(54) CONVERSION KIT FOR LIGHTING ASSEMBLIES

(75) Inventors: Paul Kenneth Pickard, Morrisville, NC (US); Gary David Trott, Cary, NC (US); Daniel W. Niles, Raleigh, NC (US); James Michael Lay, Cary, NC (US)

(73) Assignee: Cree, Inc., Durham, NC (US)

( * ) Notice: Subject to any disclaimer, the term of this patent is extended or adjusted under 35 U.S.C. 154(b) by 502 days.

(21) Appl. No.: 12/193,468

(22) Filed: Aug. 18, 2008

(65) Prior Publication Data

US 2009/0284958 A1 Nov. 19, 2009

Related U.S. Application Data

(60) Provisional application No. 61/127,923, filed on May 16, 2008.

(51) Int. Cl.
*F21S 1/02* (2006.01)

(52) U.S. Cl. ..... 362/148

(58) Field of Classification Search ..... 362/147, 362/148, 364, 365; 439/537
See application file for complete search history.

(56) References Cited

U.S. PATENT DOCUMENTS

| | | | | | |
|---|---|---|---|---|---|
| 1,483,252 | A * | 2/1924 | Symmes | 248/343 |
| 2,741,695 | A * | 4/1956 | Schockett | 362/294 |
| 4,399,371 | A * | 8/1983 | Ziff et al. | 307/147 |
| 4,459,648 | A * | 7/1984 | Ullman | 362/307 |
| 4,936,789 | A * | 6/1990 | Ugalde | 439/236 |
| 5,073,845 | A * | 12/1991 | Aubrey | 362/650 |
| 5,075,831 | A * | 12/1991 | Stringer et al. | 362/365 |
| 5,145,247 | A * | 9/1992 | Mandy | 362/148 |
| 5,580,158 | A * | 12/1996 | Aubrey et al. | 362/640 |
| 5,581,448 | A * | 12/1996 | Harwood | 362/147 |
| 5,716,125 | A * | 2/1998 | Aubrey | 362/260 |
| 6,162,100 | A * | 12/2000 | Al-Turki | 439/644 |
| 6,505,960 | B2 * | 1/2003 | Schubert et al. | 362/365 |
| 6,565,230 | B2 * | 5/2003 | Ashley | 362/650 |
| 6,582,106 | B2 * | 6/2003 | Jamison | 362/396 |
| 6,685,339 | B2 * | 2/2004 | Daughtry et al. | 362/249.05 |
| 6,911,915 | B2 * | 6/2005 | Wu et al. | 340/815.45 |
| 6,964,504 | B2 * | 11/2005 | Newbold | 362/375 |
| 6,994,457 | B2 * | 2/2006 | Lee | 362/366 |
| 7,118,254 | B2 * | 10/2006 | Czech | 362/365 |
| 7,191,993 | B2 * | 3/2007 | Bobrowski | 248/318 |
| 7,204,602 | B2 * | 4/2007 | Archer | 362/101 |
| 7,357,541 | B2 * | 4/2008 | Gamache et al. | 362/448 |
| 7,407,418 | B1 * | 8/2008 | Harlan | 439/699.2 |
| 7,614,769 | B2 * | 11/2009 | Sell | 362/365 |
| 7,673,842 | B2 * | 3/2010 | Nevers et al. | 248/343 |
| 7,748,868 | B2 * | 7/2010 | Patti et al. | 362/269 |
| 2003/0139078 | A1 * | 7/2003 | Ruthenberg | 439/236 |
| 2007/0279903 | A1 | 12/2007 | Negley et al. | |

* cited by examiner

*Primary Examiner* — Neil Abrams
(74) *Attorney, Agent, or Firm* — Jenkins, Wilson, Taylor & Hunt, P.A.

(57) ABSTRACT

Apparatuses and methods for adapting unfinished lighting fixture rough-ins to receive a lighting module, such as an incandescent light bulb or a light-emitting diode (LED) lighting device, are disclosed. According to one aspect, a universal adapter is provided that can be inserted into an existing lighting fixture rough-in, secured in place, and electrically connected to the lighting fixture rough-in. In this way, the adapter stands in place of the finishing section typically used in current lighting fixture designs. As a result, the adapter can modify an unfinished lighting fixture so that it can be used with a variety of lighting elements beyond those designed to be used with the specific configuration of the lighting fixture rough-in.

41 Claims, 6 Drawing Sheets

CONVERSION KIT FOR LIGHTING ASSEMBLIES

RELATED APPLICATIONS

The presently disclosed subject matter claims the benefit of U.S. Provisional Patent Application Ser. No. 61/127,923, filed May 16, 2008; the disclosure of which is incorporated herein by reference in its entirety.

TECHNICAL FIELD

The subject matter described herein relates to lighting fixtures. More particularly, the subject matter described herein relates to recessed lighting fixtures for mounting within a wall or ceiling.

BACKGROUND

A recessed light or downlight is a lighting fixture that is installed into a hollow opening in a ceiling or wall. A large percentage of residential recessed lighting fixtures include a metal cylinder ("can") mounted into the ceiling using horizontal metal struts attached to the ceiling framework. A light bulb socket is mounted within the cylinder, into which a light bulb can be inserted. The light bulb is commonly a 60 W incandescent light bulb or a 15 W compact fluorescent bulb. This arrangement provides structural support and the electrical connection for the light bulb installed. Further, the cylinder can be substantially airtight around the sides and top to prevent the loss of ambient heat or cooling from the room into the ceiling cavity through the fixture, and the cylinder can shield the light bulb from any insulation placed around the can within the ceiling cavity to help prevent the light bulb from starting a fire.

An insert can be installed into the can to provide a better fit for the light bulb, to reflect at least some of the light directed into the fixture, or to simply improve the aesthetic appearance of the lighting fixture. This insert is often referred to as a trim portion. By modifying the basic arrangement in this way, a single fixture can be adapted for use with a wide variety of shapes and styles of lighting elements. The ability to modify the fixture is not limited to using different trim portions to accommodate different incandescent light bulbs, though. For instance, U.S. Patent Application Pub. No. 2007/0279903 to Negley et al. discloses a lighting device containing a group of solid state light emitters (e.g., light-emitting diodes) that can be used in the kind of standard residential recessed lighting fixture discussed above.

Unfortunately, the generally standardized and easily modified design of residential recessed lights is not carried over to the commercial lighting market. Because many commercial applications involve lighting being recessed in drop ceilings, there is generally no contact with insulation and thus there is not necessarily a need for a cylindrical can to be included in the fixture. Rather, a lighting fixture rough-in can be installed. As will be understood by those having skill in the art, a lighting fixture rough-in is a base structural component that can be mounted between ceiling joists or other structural members of a commercial drop ceiling and that serves as a frame to provide support for the components of the lighting fixture. For example, a lighting fixture rough-in of this kind can often simply include a frame, often referred to as a "pan", mounted into the ceiling using horizontal metal struts attached to the ceiling framework. An example of a typical lighting fixture rough-in of this kind is shown in FIG. 1. The lighting fixture rough-in 10 can include a frame 12 defining an aperture 14 in which the lighting element will reside. Lighting fixture rough-in 10 also generally includes an electrical junction box 20 for connecting the fixture to the building power supply. Further, a junction head 22 having a junction socket 24 can be connected to the junction box 20. Of course, rough-in 10 can provide support for a variety of other components, including for example wiring, additional ballast, or thermal protection.

As is shown in FIG. 2, a finishing section 16 can then be positioned within aperture 14 and secured to frame 12 to complete the lighting fixture. The use of finishing section 16 is analogous to the use of a trim section in residential fixtures, and thus finishing section 16 can be specifically shaped to match the shape of the lighting element to be installed and to provide desirable reflective properties of the finished lighting fixture. To install finishing section 16, junction socket 24 is generally clipped directly to finishing section 16 using mounting clips 26. Oftentimes, one or both of the connections between finishing section 16 and frame 12 and that between finishing section 16 and junction socket 24 are specifically designed so that other finishing sections cannot be readily substituted. As a result, a user desiring to install a different kind of lighting element can be forced to replace lighting fixture rough-in 10 in its entirety rather than simply changing out finishing section 16.

Thus, whereas residential fixtures can generally be easily adapted for use with a wide variety of light bulbs or other lighting elements, the options for the kinds of lighting elements that can be used with these can-less commercial fixtures are often limited by the specific configuration of the lighting fixture rough-in.

SUMMARY

According to the present disclosure, novel assemblies for use in lighting fixtures are provided for adapting unfinished lighting fixture rough-ins to receive a lighting element, such as an incandescent light bulb or a light-emitting diode (LED) lighting device.

In one aspect, the present disclosure provides a universal adapter for connecting an LED lighting module to a commercial lighting fixture rough-in. The universal adapter can include an adapter body positioned within a lighting fixture rough-in for receiving an LED lighting module. In addition, the present disclosure also provides a method for adapting a lighting fixture rough-in for use with an LED lighting module. The method can include providing a universal adapter having an adapter body, positioning the adapter body within the lighting fixture rough-in, inserting an LED lighting module into the adapter body, and connecting the LED lighting module to a power source.

In another aspect, the present disclosure provides a universal adapter for connecting a lighting element to a commercial lighting fixture rough-in. The universal adapter can include an adapter body positioned within a lighting fixture rough-in, an adapter socket positioned in the adapter body, and an electrical connector operatively connected to the adapter socket. The adapter body can be adapted for receiving a lighting element, the adapter socket can serve to secure the lighting element within the adapter body, and the electrical connector can serve to electrically connect the adapter socket to a power source.

Further, the present disclosure also provides a method for adapting a lighting fixture rough-in for use with a lighting element. This method can involve providing a universal adapter having an adapter body, an adapter socket positioned in the adapter body, and an electrical connector operatively connected to the adapter socket. The method can further involve positioning the adapter body within the lighting fixture rough-in and connecting a lighting element to the adapter socket.

The present invention may be more fully understood with reference to the accompanying drawings and the following detailed description.

BRIEF DESCRIPTION OF THE DRAWINGS

Preferred embodiments of the subject matter described herein will now be explained with reference to the accompanying drawings of which.

DETAILED DESCRIPTION

Lighting fixtures are described herein with reference to FIGS. 1-7. As illustrated in FIGS. 1-7, some sizes of structures or portions may be exaggerated relative to other structures or portions for illustrative purposes and, thus, are provided to illustrate the general structures of the subject matter disclosed herein. Further, various aspects of the subject matter disclosed herein are described with reference to a structure or a portion being formed on other structures, portions, or both. As will be appreciated by those of skill in the art, references to a structure being formed "on" or "above" another structure or portions contemplates that additional structure, portion, or both may intervene. References to a structure or a portion being formed "on" another structure or portion without an intervening structure or portion are described herein as being formed "directly on" the structure or portion.

Furthermore, relative terms such as "on" or "above" are used herein to describe one structure's or portion's relationship to another structure or portion as illustrated in the Figures. It will be understood that relative terms such as "on" or "above" are intended to encompass different orientations of the device in addition to the orientation depicted in the Figures. For example, if the device in the Figures is turned over, structure or portion described as "above" other structures or portions would now be oriented "below" the other structures or portions. Likewise, if the device in the Figures is rotated along an axis, structure or portion described as "above" other structures or portions would now be oriented "next to" or "left of" the other structures or portions. Like numbers refer to like elements throughout.

Figure 1:
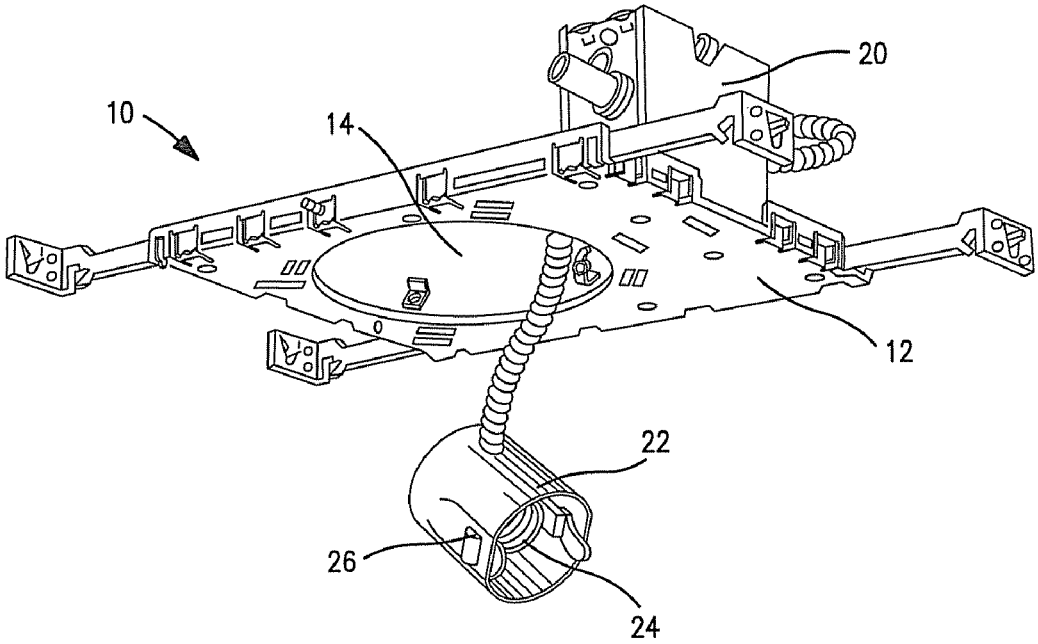
FIG. 1 PRIOR ART
FIG. 1 is a perspective side view of a lighting fixture rough-in that is typical of those found in the commercial lighting market.
Figure 2:
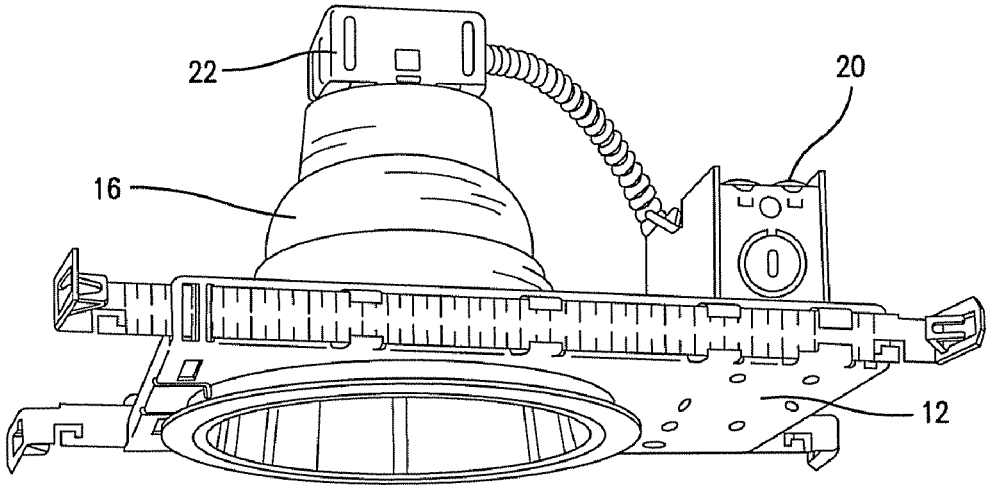
FIG. 2 PRIOR ART
FIG. 2 is a perspective side view of a typical lighting fixture including a finishing section.
Figure 3:
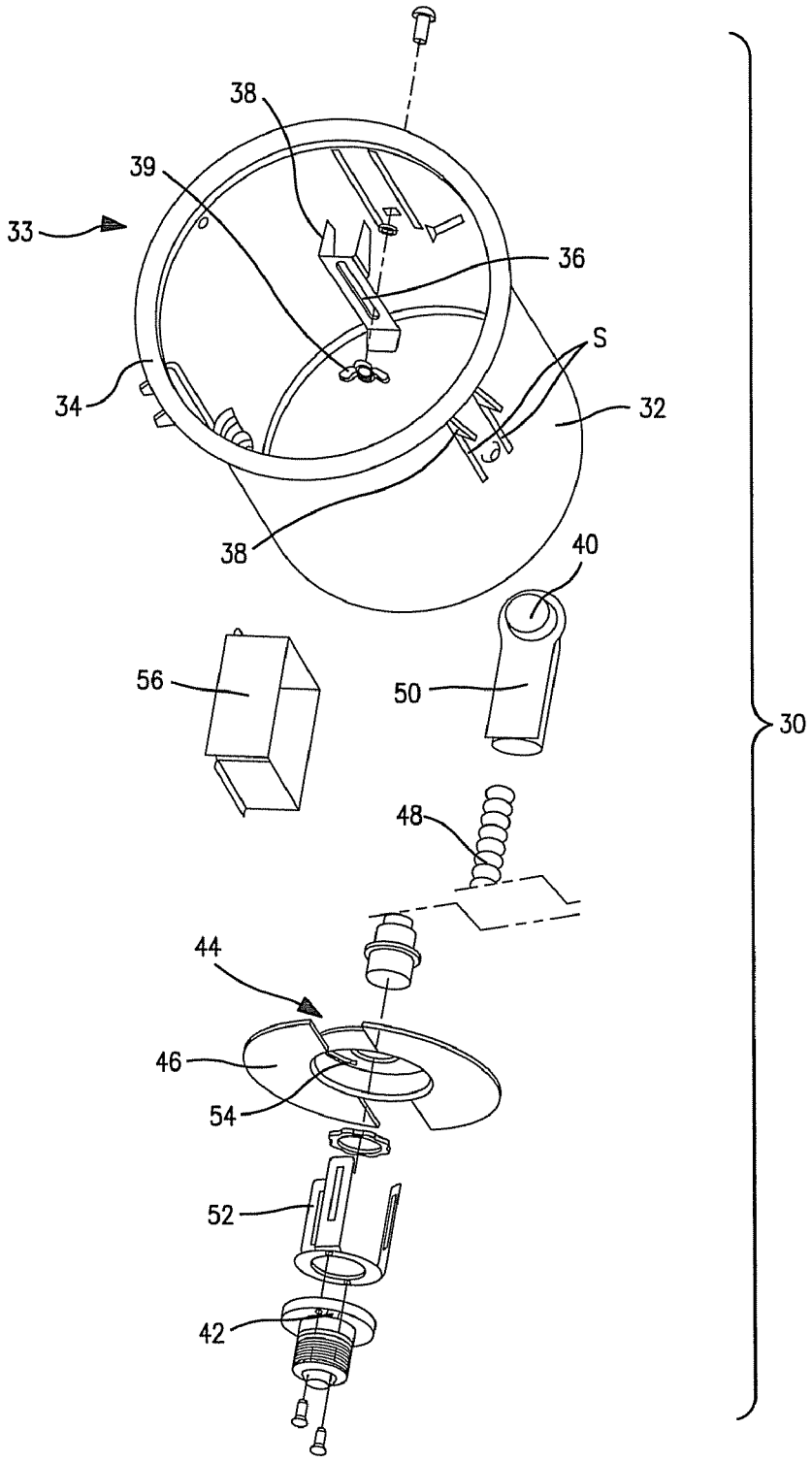
FIG. 3 is an exploded perspective view of a universal adapter for connecting a lighting element to a lighting fixture rough-in according to an embodiment of the subject matter disclosed herein.
Figure 4:
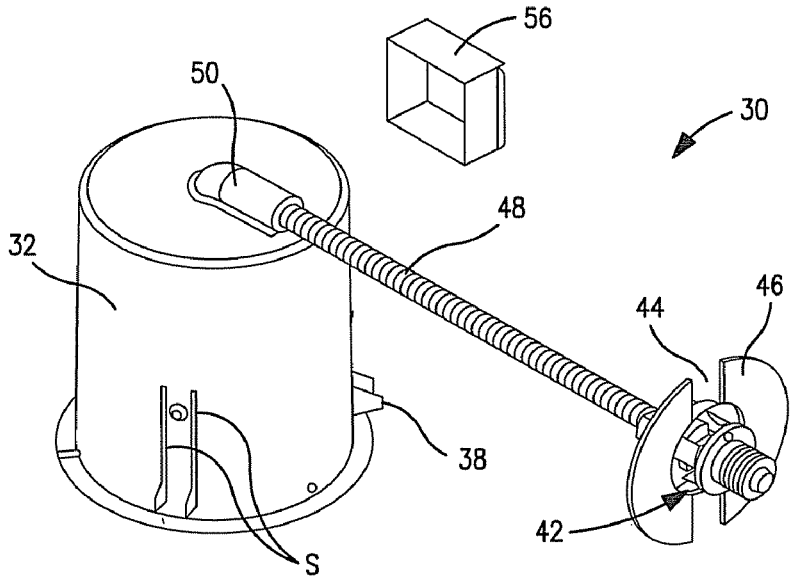
FIG. 4 is a perspective view of a universal adapter for connecting a lighting element to a lighting fixture rough-in according to the subject matter disclosed herein.
Figure 5:
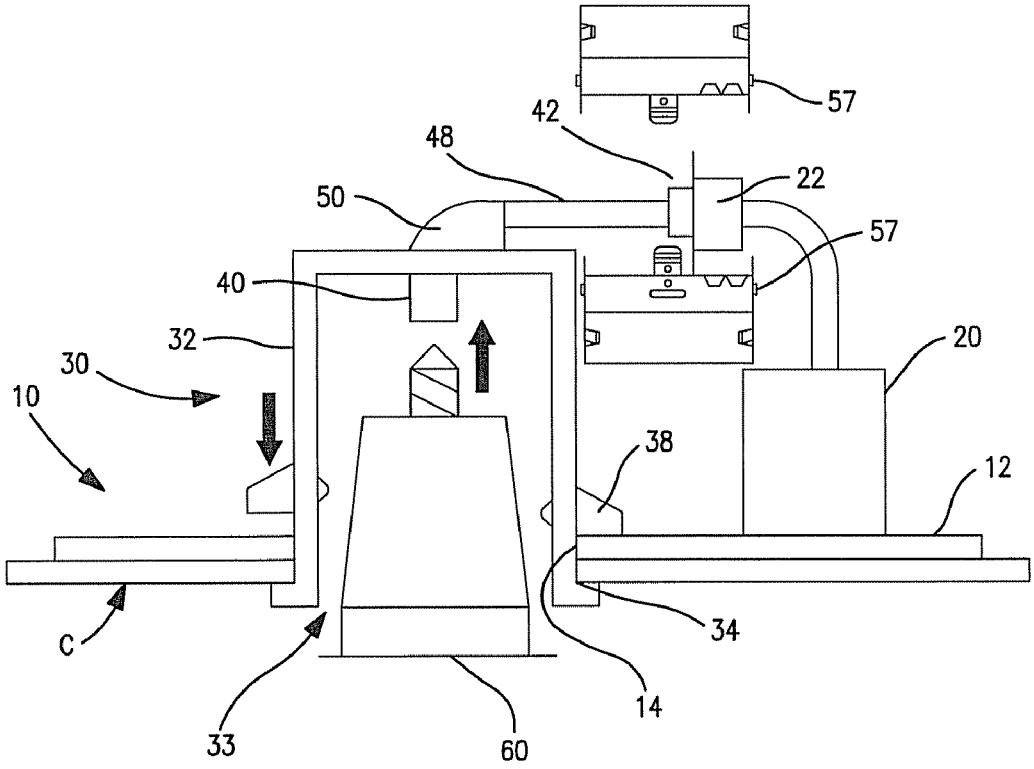
FIG. 5 is a vertical cross-sectional view of a universal adapter mounted in a lighting fixture rough-in according to the subject matter disclosed herein.

According to one aspect of the subject matter disclosed herein, a universal adapter is provided for connecting a lighting element to a lighting fixture rough-in, such as a typical lighting fixture rough-in described above. Referring to FIGS. 3-5, a universal adapter 30 for this function can include an adapter body 32. When coupled to a lighting fixture rough-in 10, adapter body 32 can be positioned within an aperture 14 in the frame 12 of lighting fixture rough-in 10. In addition, universal adapter 30 can also include an adapter socket 40 connected to adapter body 32, and an electrical connector 42 serving to electrically connect adapter socket 40 to a power source. Electrical connector 42 can be coupled to a junction socket 24 in a junction head 22 connected to an electrical junction box 20 on lighting fixture rough-in 10. In this way, universal adapter 30 stands in place of the finishing section 16 used in current lighting fixture designs (see FIG. 2), and in doing so can adapt a single lighting fixture for use with a larger variety of lighting elements 60.

Adapter body 32 can include at least a first end and a second end and can be configured to be used with a lighting element 60 by being open at one end for receiving lighting element 60. For instance, adapter body 32 can have a substantially cylindrical shape similar to the shape of the cylindrical can formed in many residential lighting fixtures. Adapter socket 40 can be secured to one end of the cylindrical adapter body 32, and the opposite end of the cylindrical adapter body 32 can be an open end 33 for receiving lighting element 60. Therefore, adapter body 32 can be used to modify a commercial lighting fixture rough-in 10 to emulate the universal can of residential downlight fixtures. As such, a wide variety of light bulbs can be used in the adapted lighting fixture, even those for which a corresponding finishing section 16 designed to fit in aperture 14 does not exist. Specifically, an LED lighting device adapted for use with standard residential downlight fixtures can be received in adapter body 32 to be used in lighting fixture rough-in 10.

One example of such an LED device is the LR6 downlight retrofit element sold by Cree LED Lighting Solutions, Inc., a subsidiary of Cree, Inc. of Durham, N.C. The LR6 is designed to be easily installed in standard 6-inch recessed lighting fixtures through the use of locking clips that are movable to engage the interior sidewalls of the cylindrical can of a standard lighting fixture. The use of universal adapter 30 thus provides a similar structure to typical residential lighting fixtures, enabling the locking clip design of the LR6 to be used with lighting fixture rough-ins 10 that do not have a can.

As noted above, adapter body 32 can further be configured to be positioned within aperture 14 in frame 12. In particular, adapter body 32 can be sized so that the end connected to adapter socket 40 and electrical connector 42 is no larger than aperture 14. That being said, it should be noted that adapter body 32 need not fit perfectly through aperture 14, and it can be desirable for adapter body 32 to be sized to easily pass through aperture 14 with a reasonable amount of clearance. In this way, the use of universal adapter 30 is not limited to a lighting fixture rough-in 10 having a particular size aperture 14.

When properly sized, adapter body 32 can be inserted into aperture 14 to be coupled with frame 12. To ensure that adapter body 32 cannot be inserted completely through aperture 14, adapter body 32 can include a flange 34 extending outwardly that cannot pass through aperture 14. For example, flange 34 can be positioned at or near the open end 33 of adapter body 32. When the lighting fixture rough-in 10 is installed above a ceiling, flange 34 supports adapter body 32 in place with respect to the ceiling, with open end 33 of adapter body 32 lying substantially flush with the surface of the ceiling C. Such an arrangement is desirable because it can make the finished lighting fixture as unobtrusive as possible.

To couple adapter body 32 to frame 12 of lighting fixture rough-in 10 and thereby prevent universal adapter 30 from being easily dislodged from its position within aperture 14, one or more retainers 36 can be provided on adapter body 32 (see FIG. 3). Retainers 36 can include a plurality of clips positioned about adapter body 32, with a gripping portion 38 extending away from adapter body 32 to engage frame 12. For example, as is shown in FIG. 3, retainers 36 can be releasably fastened to the interior surface of adapter body 32 by fasteners 39 (e.g., bolt and wing nut fastener), with gripping portion 38 passing through adapter body 32 and engaging fame 12 about the periphery of aperture 14. Gripping portion 38 can be sized so that, when retainers 36 are securely fastened to adapter body 32, adapter body 32 can not be pulled through aperture 14.

Retainers 36 can be moveable with respect to adapter body 32 to adjust the position of adapter body 32 with respect to frame 12. Stated otherwise, retainers 36 can be releasably engaged with adapter body 32 and capable of sliding along the length of adapter body 32 relative to open end 33 along adapter slots S within adapter body 32. In this way, the distance between flange 34 and gripping portion 38 is adjustable so that universal adapter 30 can be coupled to lighting fixture rough-in 10 regardless of the thickness of ceiling C. The combination of flange 34 and retainers 36 effectively clamp about the combined thickness of frame 12 and ceiling C to hold adapter body 32 in place. For instance, retainers 36 can be adjusted so that adapter body 32 extends only far enough from frame 12 to accommodate a 3/8 inch plyboard ceiling between frame 12 and flange 34. Alternatively, retainers 36 can be adjusted away from flange 34 such that a thicker ceiling can be accommodated, such as a ¾ inch plaster ceiling or even a ceiling as thick as 2 inches or more.

With universal adapter 30 securely mounted within frame 12, a trim portion can be provided just as is generally done in residential lighting fixtures. As noted above, the inclusion of a trim portion can help provide a better fit for lighting element 60, it can reflect at least some of the light directed into the fixture, and it can improve the aesthetic appearance of the lighting fixture. Alternatively, lighting element 60 can include elements serving the purpose of a trim portion. Namely, lighting element 60 can be sized to readily fit into adapter body 32, and visible features can be designed to be visually pleasing. Further still, adapter body 32 itself can be designed to be aesthetically pleasing so that no trim portion is needed.

Adapter socket 40 can be configured to receive lighting element 60, thereby securing lighting element 60 to lighting fixture rough-in 10. In this regard, adapter socket 40 can be of the widely used screw-in ("Edison") type socket. Alternatively, adapter socket 40 can be a GU-24 type socket, which is designed to work with line voltage sockets used for energy-efficient compact fluorescent bulbs.

Of course, adapter socket 40 not only provides physical support for lighting element 60, but also provides an electrical connection for lighting element 60. In this regard, electrical connector 42 serves to electrically connect adapter socket 40 to electrical junction box 20 of lighting fixture rough-in 10. Specifically, electrical connector 42 can be a screw-in type plug where junction head 22 includes an Edison-type junction socket 24. In this arrangement, instead of a light bulb being directly connected to electrical junction box 20 through junction socket 24, electrical connector 42 is used to bridge the electrical connection from electrical junction box 20 to adapter socket 40.

To account for varying configurations of junction socket 24 and junction head 22 extending from electrical junction box 20, electrical connector 42 can include an electrical conduit 48 connecting adapter socket 40 to electrical connector 42. The inclusion of electrical conduit 48 provides flexibility in connecting and securing universal adapter 30 in place. In addition, the connection of electrical connector 42 to adapter socket 40 can be an angled fitting 50 (e.g., 90° fitting) to place the attachment in the center of the end of adapter body 32. In addition, this kind of fitting 50 provides a low-profile connection to adapter body 32, which can address space issues caused by the size and shape of adapter body 32 being different than finishing section 16 designed for use with lighting fixture rough-in 10.

Figure 6A:
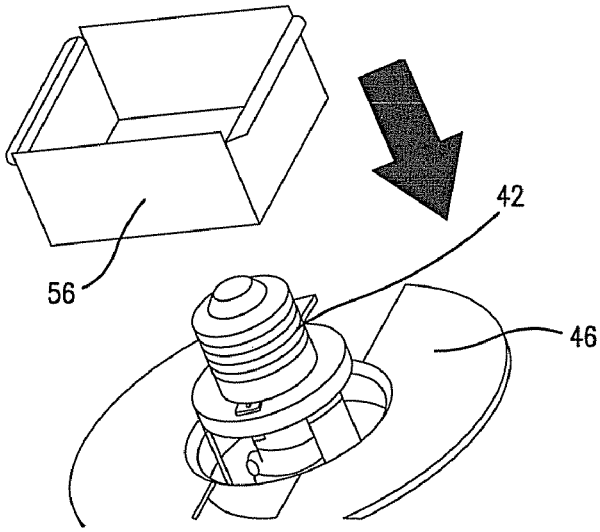
FIGS. 6*a*-6*f* illustrate steps in the installation of a universal adapter to a lighting fixture rough-in according to the subject matter disclosed herein.

Because junction head 22 is often designed to be coupled directly with finishing section 16 (see FIG. 2), electrical connector 42 can additionally be configured to duplicate the kind of connection used in the typical fixture design. Namely, many junction heads 22 have mounting clips 26 designed to engage corresponding notches in a finishing section 16, so electrical connector 42 can similarly include notches 44 designed to connect with mounting clips 26 to make a seamless fit between junction head 22 and electrical connector 42. Further, electrical connector 42 can include an enclosure structure 46 to surround the connection of electrical connector 42 to junction head 22 and thus ensure that there is no exposed electrical connection. In addition, as illustrated in FIG. 6*a*, an enclosure box 56 can be provided to connect electrical connector 42 to non-standard electrical junctions (e.g., Lithonia Lighting P/N LP6J6).

Figure 6B:
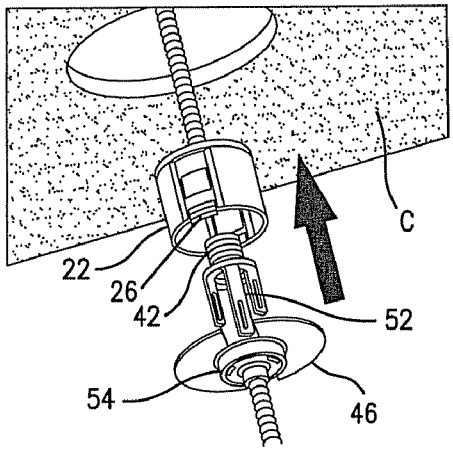
Figure 6C:
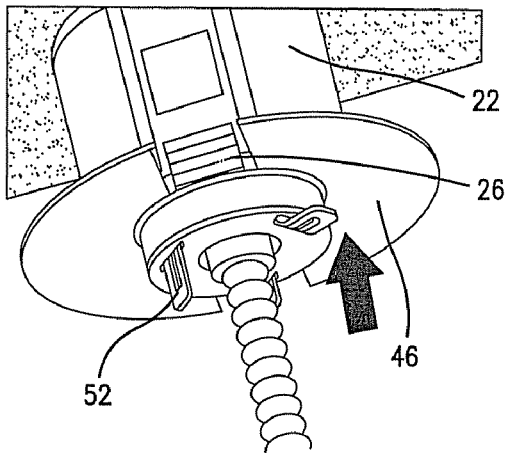

Enclosure structure 46 can be secured onto electrical connector 42 by a tri-clip/slot mating feature with bendable tabs. With this kind of feature, which is illustrated in FIGS. 3 and 6*b*, the tri-clip 52 on electrical connector 42 can be disengaged from slots 54 on enclosure structure 46 to allow an installer to more easily manipulate electrical connector 42 to connect it to junction socket 24. Thus, electrical connector 42 can more easily be screwed into junction socket 24. Once the electrical connection is made, tri-clip 52 can be reinserted into slots 54 and the bendable tabs of tri-clip 52 pressed down as is shown in FIG. 6*c* to lock enclosure structure 46 around electrical connector 42. Accordingly, electrical connector can be safely and securely connected to junction head 22 to provide the electrical connection to lighting element 60.

Figure 6D:
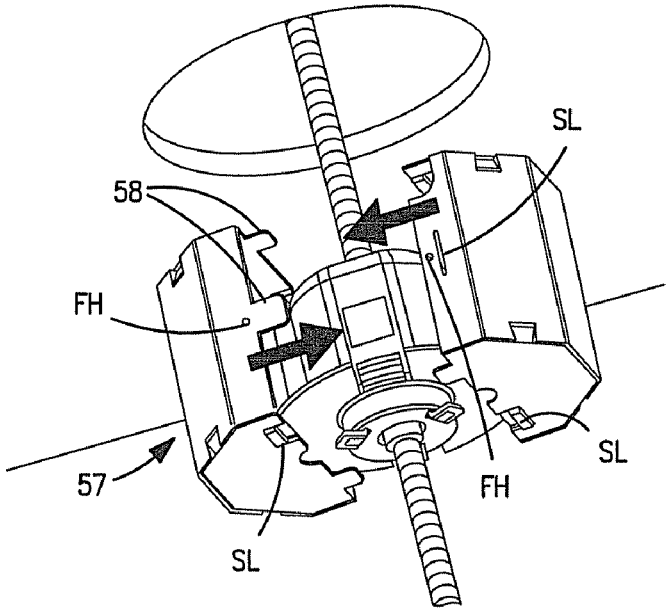
Figure 7:
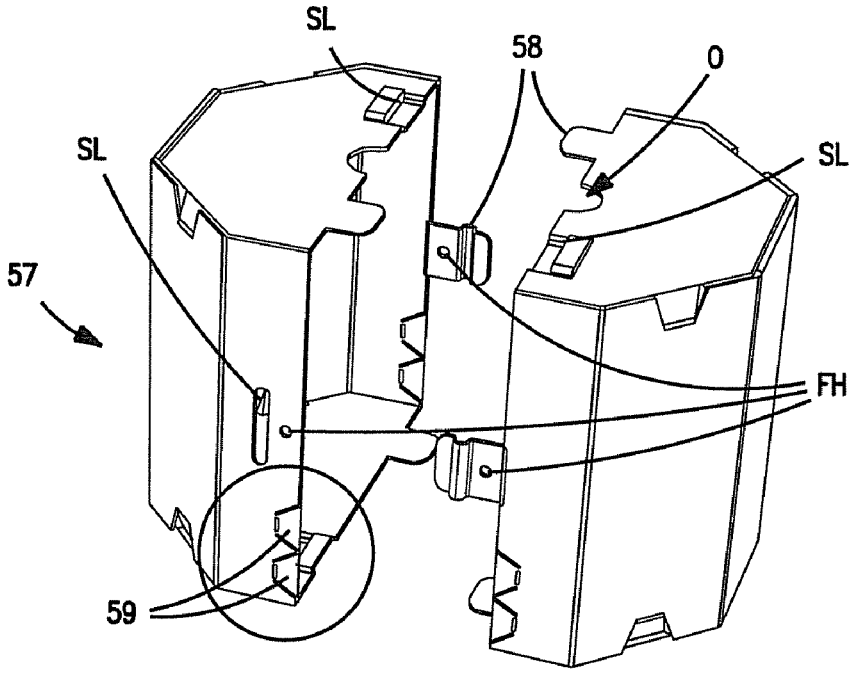
FIG. 7 is a perspective view of a clamshell-type enclosure structure for use with the universal adapter according to the subject matter disclosed herein.

The connection of electrical connector 42 to junction socket 24 can be further shielded by an additional, secondary enclosure structure. For instance, a clamshell-type enclosure structure 57 can be positioned to surround electrical connector 42 and junction head 22. One example of such clamshell enclosure 57 is illustrated in FIGS. 5, 6*d*, and 7. This additional clamshell enclosure 57 provides a mating head design that matches the wide variety of Edison socket shields (i.e., enclosure structure 46) well enough to pass electrical and safety code. Specifically, for example, in order to pass UL, the electrical connection needs to be completely enclosed. Therefore, clamshell enclosure 57 is clamped around the mated junction head 22 and electrical connector 42 in order to provide the desired electrical shield.

In another aspect, the disclosed subject matter can include a method for using the above described universal adapter 30 to adapt a lighting fixture rough-in 10 for use with a lighting element 60. Just as disclosed above, lighting fixture rough-in 10 can include a frame 12 defining an aperture 14 therethrough and an electrical junction box 20. Connecting universal adapter 30 to lighting fixture rough-in 10 can involve connecting electrical connector 42 to electrical junction box 20 of lighting fixture rough-in 10. As noted above, and as illustrated in FIG. 6*b*, this connecting can be accomplished by connecting mounting clips 26 on junction head 22 with notches 44 formed in electrical connector 42. Further, as illustrated in FIGS. 3 and 6*c*, the step of connecting can also include manipulating a tri-clip/slot mating feature to lock an enclosure structure 46 about electrical connector 42.

The now-connected junction head 22 and electrical connector 42 can further be enclosed inside clamshell enclosure 57, as is depicted in FIG. 6*d*. Guide tabs 58 can be inserted into corresponding enclosures slots SL to align and join two halves of clamshell enclosure 57, ensuring that the junction-side conduit exits through a top center opening O of clamshell enclosure 57 and the adapter-side electrical conduit 48 exits through an opening on the side of clamshell enclosure 57. As is depicted in FIG. 7, sets of removable tabs 59 can be removable from clamshell enclosure 57 to form this side opening for routing the adapter-side electrical conduit 48 out of clamshell enclosure 57. Multiple sets of removable tabs 59 can be provided so as to allow for multiple configurations of junction head 22 and electrical connector 42. Two halves of clamshell enclosure 57 can be locked together, for example, using a fastener (e.g., a single screw) on one side of clamshell enclosure 57 where two fastening holes FH line up in registration one with the other.

Figure 6E:
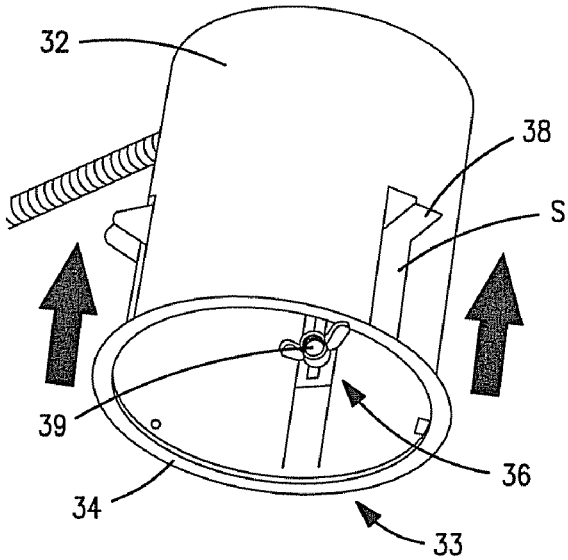
Figure 6F:
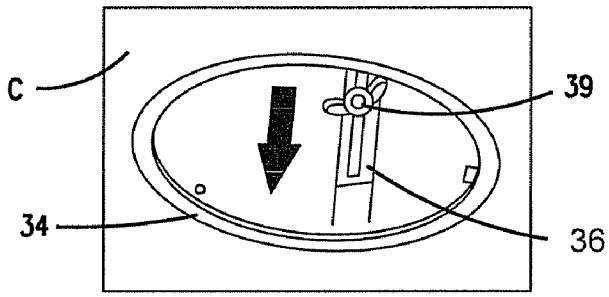

Once the electrical connection is made and the connectors safely enclosed, adapter body 32 can be inserted through aperture 14 in frame 12 of lighting fixture rough-in 10. Flange 34 can brace adapter body 32 against the ceiling or wall above which lighting fixture rough-in 10 is installed. In the other direction, the position of retainers 36 can be adjusted so that they engage frame 12 and support adapter body 32 in place with respect to aperture 14. For instance, as is shown in FIGS. 3 and 6*e*, retainers 36 can be adjusted to be in their highest position relative to open end 33 of adapter body 32 and fasteners 39 lightly tightened to temporarily hold retainers 36 in this position. Adapter body 32 can then be inserted through aperture 14 until flange 34 encounters the ceiling or wall, and thus adapter body 32 is in the desired position. Once adapter body 32 is properly positioned, as illustrated in FIG. 6*f*, fasteners 39 can be loosened and retainers 36 can be pressed downwardly until gripping portion 38 engages frame 12 (see also FIG. 5). With retainers 36 in the desired locking position, fasteners 39 can again be tightened to lock retainers 36 in place. In this way, adapter body 32 can be effectively locked onto lighting fixture rough-in 10. If additional support is desired, additional fasteners (e.g., sheet metal screws) can be used to secure adapter body 32 to frame 12.

Lighting element 60 can be inserted into open end 33 of adapter body 32 and connected to adapter socket 40 to create a completed lighting fixture. As noted above, depending on the configuration of lighting element 60, a trim portion can be provided to help provide a better fit for lighting element 60, reflect at least some of the light directed into adapter body 32, and/or improve the aesthetic appearance of any exposed portions of the lighting fixture.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. An adapter for connecting an LED lighting module to a commercial lighting fixture rough-in for an originally intended lighting fixture designed for a light bulb and having a finishing section configured for receiving the light bulb, the lighting fixture rough-in comprising a mounting frame and a junction box with a junction socket electrically connected to the junction box and configured for receiving the light bulb for which the lighting fixture is designed, the adapter comprising:

an adapter body configured for receiving an LED lighting module and for positioning within the lighting fixture rough-in to replace the finishing section of the originally intended lighting fixture; and an electrical connector extending from the adapter body and configured to couple with the junction socket to electrically connect the LED lighting module with the junction socket.

2. The adapter of claim 1, wherein the adapter body has a substantially cylindrical shape and first and second ends, wherein one of the first or second ends of the cylindrical adapter body is open for receiving an LED lighting module.

3. The adapter of claim 2, wherein the adapter body comprises a flange extending from the open end of the adapter body, and the lighting fixture rough-in is installed above a ceiling wherein the flange supports the adapter body in place with respect to the ceiling when the adapter body is positioned in the lighting fixture rough-in.

4. The adapter of claim 1, wherein one or more retainers are provided in the adapter body to adjust the position of the adapter body with respect to the frame of the lighting fixture rough-in when the adapter body is positioned in the lighting fixture rough-in.

5. The adapter of claim 1, comprising an adapter socket positioned in the adapter body, the adapter socket serving to secure the LED lighting module within the adapter body, and the adapter socket operatively connected to the electrical connector.

6. The adapter of claim 5, wherein the adapter socket is an Edison connector.

7. The adapter of claim 5, wherein the adapter socket is a GU-24 connector.

8. The adapter of claim 5, comprising an electrical conduit connecting the adapter socket to the electrical connector.

9. The adapter of claim 8, wherein the electrical conduit comprises a 90° fitting coupling the electrical conduit to the adapter socket at the adapter body.

10. The adapter of claim 1, wherein the electrical junction box comprises a junction head connected to the junction socket.

11. The adapter of claim 1, wherein the electrical connector comprises an enclosure structure covering, the connection to the junction socket.

12. A method for adapting a lighting fixture rough-in for use with an LED lighting module, the lighting fixture rough-in for an originally intended lighting fixture designed for a light bulb and having a finishing section configured for receiving the light bulb and the lighting fixture rough-in comprising a mounting frame and a junction box with a junction socket electrically connected to the junction box and configured for receiving the light bulb for which the lighting fixture is designed, the method comprising:

(a) providing an adapter comprising an adapter body and an electrical connector extending from the adapter body;

(b) positioning the adapter body within the lighting fixture rough-in to replace the finishing section of the originally intended lighting fixture;

(c) inserting an LED lighting module into the adapter body; and (d) connecting the LED lighting module to a power source by coupling the electrical connector to the junction socket.

13. The method of claim 12, wherein providing an adapter comprises providing an adapter having an adapter socket positioned in the adapter body, and the electrical connector operatively connected to the adapter socket.

14. The method of claim 13, wherein providing an adapter having an adapter socket comprises providing an adapter having an Edison connector.

15. The method of claim 13, wherein providing an adapter having an adapter socket comprises providing an adapter having a GU-24 connector.

16. The method of claim 13, wherein the electrical junction box comprises a junction head, the junction head connected to the junction socket

17. The method of claim 12, comprising providing an enclosure structure engagable to the electrical connector and covering the connection of the electrical connector to the junction socket with the enclosure structure.

18. The method of claim 16, comprising:

providing mounting clips on the electrical junction box and providing notches on the electrical connector corresponding to the mounting clips;

wherein connecting the electrical connector to the electrical junction box of the lighting fixture rough-in comprises inserting the mounting clips into the notches.

19. The method of claim 12, comprising:

installing the lighting fixture rough-in above a ceiling; and providing a flange extending from one end of the adapter body;

wherein positioning the adapter body within the lighting fixture rough-in comprises adjusting the adapter body until the flange engages the ceiling.

20. The method of claim 12, wherein inserting an LED lighting module into the adapter body comprises inserting a lighting device having a plurality of light emitting diodes (LEDs) into the adapter body.

21. An adapter for connecting a lighting element to a commercial lighting fixture rough-in, the lighting fixture rough-in for an originally intended lighting fixture designed for a light bulb and having a finishing section configured for receiving the light bulb and the lighting fixture rough-in comprising a mounting frame and a junction box with a junction socket electrically connected to the junction box and configured for receiving the light bulb for which the lighting fixture is designed, the universal adapter comprising:

(a) an adapter body configured for receiving a lighting element and for positioning within the lighting fixture rough-in to replace the finishing section of the originally intended lighting fixture;

(b) an adapter socket positioned in the adapter body, the adapter socket serving to secure a lighting element within the adapter body; and (c) an electrical connector operatively connected to the adapter socket, the electrical connector configured to couple with the junction socket serving to electrically connect the adapter socket to a power source.

22. The adapter of claim 21, wherein the lighting element is selected from the group consisting of an LED lighting module, an incandescent light, and a fluorescent light.

23. The adapter of claim 21, wherein the adapter body has a substantially cylindrical shape and first and second ends, wherein one of the first or second ends of the cylindrical adapter body is open for receiving an LED lighting module, and the adapter socket is secured to the other of the first or second ends of the cylindrical adapter body.

24. The adapter of claim 23, wherein the adapter body comprises a flange extending from the open end of the adapter body and the lighting fixture rough-in is installed above a ceiling, and wherein the flange supports the adapter body in place with respect to the ceiling when the adapter body is positioned in the lighting fixture rough-in.

25. The adapter of claim 21, wherein one or more retainers are provided in the adapter body to adjust the position of the adapter body with respect to the frame of the lighting fixture rough-in when the adapter body is positioned in the lighting fixture rough-in.

26. The adapter of claim 21, wherein the adapter socket is an Edison connector.

27. The adapter of claim 21, wherein the adapter socket is a GU-24 connector.

28. The adapter of claim 21, wherein the electrical junction box comprises a junction head connected to the junction socket.

29. The adapter of claim 28, wherein the electrical connector comprises an enclosure structure covering the connection to the junction socket.

30. The adapter of claim 21, further comprising an electrical conduit connecting the adapter socket to the electrical connector.

31. The adapter of claim 30, wherein the electrical conduit comprises a 90° fitting coupling the electrical conduit to the adapter socket at the adapter body.

32. A method for adapting a lighting fixture rough-in for use with a lighting element, the lighting fixture rough-in for an originally intended lighting fixture designed for a light bulb and having a finishing section configured for receiving the light bulb and the lighting fixture rough-in comprising a mounting frame and a junction box with a junction socket electrically connected to the junction box and configured for receiving the light bulb for which the lighting fixture is designed, the method comprising:

(a) providing an adapter having an adapter body, an adapter socket positioned in the adapter body, and an electrical connector operatively connected to the adapter socket;

(b) positioning the adapter body within the lighting fixture rough-in to replace the finishing section of the originally intended lighting fixture; and (c) coupling the electrical connector to the junction socket; and (d) connecting a lighting element to the adapter socket.

33. The method of claim 32, wherein providing an adapter having an adapter socket comprises providing an adapter having an Edison connector.

34. The method of claim 32, wherein providing an adapter having an adapter socket comprises providing an adapter having a GU-24 connector.

35. The method of claim 32, wherein the electrical junction box comprises a junction head, the junction head connected to the junction socket.

36. The method of claim 32, comprising providing an enclosure structure engagable to the electrical connector and covering the connection of the electrical connector to the junction socket with the enclosure structure.

37. The method of claim 32, comprising:

installing the lighting fixture rough-in above a ceiling; and providing a flange extending from one end of the adapter body;

wherein positioning the adapter body within the lighting fixture rough-in comprises adjusting the adapter body until the flange engages the ceiling.

38. The method of claim 32, comprising:

providing mounting clips on the electrical junction box and providing notches on the electrical connector corresponding to the mounting clips; and inserting the mounting clips into the notches to connect the electrical connector to the electrical junction box of the lighting fixture rough-in.

39. The method of claim 32, wherein connecting a lighting element to the adapter socket comprises connecting a lighting device comprising an LED lighting module to the adapter socket.

40. A method for adapting a lighting fixture rough-in, the lighting fixture rough-in comprising a mounting frame and a junction box with a junction socket electrically connected to the junction box for use with an LED lighting module, the method comprising:

providing an adapter comprising an adapter body and an electrical connector extending from the adapter body;

positioning the adapter body within the lighting fixture rough-in;

inserting an LED lighting module into the adapter body;

connecting the LED lighting module to a power source by coupling the electrical connector to the junction socket;

wherein providing an adapter comprises providing an adapter having an adapter socket positioned in the adapter body, and the electrical connector operatively connected to the adapter socket;

wherein the electrical junction box comprises a junction head, the junction head connected to the junction socket;

providing mounting clips on the electrical junction box and providing notches on the electrical connector corresponding to the mounting clips; and wherein connecting the electrical connector to the electrical junction box of the lighting fixture rough-in comprises inserting the mounting clips into the notches.

41. A method for adapting a lighting fixture rough-in, the lighting fixture rough-in comprising a mounting frame and a junction box with a junction socket electrically connected to the junction box for use with a lighting element, the method comprising:

providing an adapter having an adapter body, an adapter socket positioned in the adapter body, and an electrical connector operatively connected to the adapter socket;

positioning the adapter body within the lighting fixture rough-in;

coupling the electrical connector to the junction socket;

connecting a lighting element to the adapter socket;

providing mounting clips on the electrical junction box and providing notches on the electrical connector corresponding to the mounting clips; and inserting the mounting clips into the notches to connect the electrical connector to the electrical junction box of the lighting fixture rough-in.

* * * * *